US005439493A

United States Patent [19]

Kirschner

[11] Patent Number: 5,439,493

[45] Date of Patent: Aug. 8, 1995

[54] ABRASIVE COATING REMOVER AND PROCESS FOR USING SAME

[75] Inventor: Lawrence Kirschner, Flanders, N.J.

[73] Assignee: Church & Dwight Co., Inc., Princeton, N.J.

[21] Appl. No.: 101,003

[22] Filed: Aug. 3, 1993

Related U.S. Application Data

[62] Division of Ser. No. 854,204, Mar. 20, 1992.

[51] Int. Cl.[6] ..... C09C 1/08

[52] U.S. Cl. ..... 51/309

[58] Field of Search ..... 51/309, 281 R, 317; 134/7

[56] References Cited

U.S. PATENT DOCUMENTS

| | | | |
|---|---|---|---|
| 2,624,988 | 1/1953 | Vander Wal | 51/282 |
| 2,710,286 | 6/1955 | Zachariason | 252/301.6 |
| 2,842,465 | 7/1958 | Harrison | 134/7 |
| 2,898,246 | 8/1959 | Hannah | 134/38 |
| 3,060,098 | 10/1962 | Gershon | 167/93 |
| 3,087,857 | 4/1963 | Davis e t al. | 167/53.2 |
| 3,775,180 | 11/1973 | Hirata et al. | 134/7 |
| 4,021,525 | 5/1977 | Poncha | 423/184 |
| 4,579,627 | 4/1986 | Brailsford | 156/655 |
| 4,588,444 | 5/1986 | Anderson | 134/2 |
| 4,731,125 | 3/1988 | Carr | 134/17 |
| 4,878,320 | 11/1989 | Woodson | 51/320 |
| 5,081,799 | 1/1992 | Kirschner et al. | 51/410 |
| 5,112,406 | 5/1992 | Lajoie et al. | 134/7 |
| 5,160,547 | 11/1992 | Kirschner et al. | 134/7 |
| 5,230,185 | 7/1993 | Kirschner et al. | 51/410 |
| 5,232,514 | 8/1993 | Van Sciver et al. | 134/7 |

FOREIGN PATENT DOCUMENTS

| | | |
|---|---|---|
| 3906394 | 9/1990 | Germany . |
| 61-075300 | 4/1986 | Japan . |

*Primary Examiner*—Deborah Jones
*Attorney, Agent, or Firm*—Charles B. Barris

[57] ABSTRACT

A blast media for removing coatings from steel comprises a major amount of a granular relatively soft abrasive such as trona, i.e., natural sodium sesquicarbonate, and a minor portion of a granular hard abrasive such as aluminum oxide.

14 Claims, No Drawings

ABRASIVE COATING REMOVER AND PROCESS FOR USING SAME

This application is a division of application Ser. No. 07/854,204, filed Mar. 20, 1992.

BACKGROUND OF THE INVENTION

This invention relates in general to a process for removing adherent material, such as paint, scale or other coverings from hard metal surfaces and, more particularly, to a non-chemical surface cleaning process employing mechanical blast.

For various types of structures, it is often necessary or desirable to remove any layer of coating which has been previously applied to or formed on surface areas. Numerous techniques exits for removing paint, sealants, lacquers, rust, scale and other adherent materials from virtually any type of surface. Surface cleaning or stripping methods range from mechanical abrasion to the use of strong chemicals and involve varying degrees of time, effort and expense. For any given type of coating, the character and function of the substrate material from which a coating is to be removed usually dictates the stripping method, at least in industrial settings. Hard, durable surfaces, such as heavy steel plating can be cleaned or stripped by relatively fast abrasive methods such as sand blasting. Softer metals such as aluminum or more delicate surfaces such as polymer composite layers may require the use of a softer abrasive material during blasting or require careful chemical removal to prevent damage or destruction of the substrate.

Sand blasting of steel plate to remove adherent coatings and the like, while successful in removing the coatings, has several disadvantages. For one, the sand abrasive is very friable such that upon contact with the surface, a vast amount of silica dust is formed. Recently there has been a concern that the minute silicious particles which are formed present a substantial health hazard, in particular, if ingested into the lungs. Secondly, very large amounts of sand are required for cleaning large structures such as bridges, stacks, etc. such that after blasting, this sand remains and must be removed from the area adding substantially to the time and expense of the process.

Alternative abrasives are known. For example, U.S. Pat. No. 3,775,180 is directed to a method for descaling steel in which the steel is descaled by spraying a mixture of a solid such as aluminum oxide or silicon carbide with water and a gas such as air under specified conditions onto the steel. In removing a coating or a scale on the surface of a metal, however, it is important that the anchor pattern (surface roughness) of the metal surface be uniform and not to extensive such that the surface and even the metal structure is damaged. A blast media composed only of hard aluminum oxide and silicon carbide can be detrimental to the metal structure. For certain surfaces such as metals softer than steel, a softer abrasive can be used with the blast stripping method. An example of such is disclosed in U.S. Pat. No. 4,878,320 to remove coatings from aluminum, fiber glass or carbon fiber laminate. As disclosed in the patent, an abrasive particle is used which has a Mohs hardness of about 3. Sodium bicarbonate is the preferred material. Likewise, the present assignee markets a sodium bicarbonate blast media such as for removing paint, scale and the like from aluminum under the tradename Armex. Although very effective for removing coatings from aluminum or other softer materials such as polymer composites and the like, sodium bicarbonate abrasive is not hard enough to provide a sufficient anchor pattern on hard surfaces such as steel so as to prime the surface for the addition of a new coating layer. A large advantage of sodium bicarbonate as a blast media is that the material is water soluble and non-toxic so that a blasting area can be cleaned relatively easily by washing the media away with water without a harmful environmental effect.

Other patents which disclose cleaning metal surfaces with an abradant other than sand includes U.S. Pat. No. 2,624,988 which utilizes Tripoli paste and a liquid vehicle and which can be mixed with sponge rubber fragments which carry the abradant to the metal surface and which provide a rubbing action to polish and buff the metal surface. The addition of a small amount of alumina to the Tripoli paste is disclosed under certain conditions.

U.S. Pat. No. 2,710,286 discloses a method of removing fluorescent and other materials from viewing screens of cathode ray tubes in which sodium and potassium carbonate are used as the abrasive material. U.S. Pat. No. 4,588,444 discloses removing calcium from polymeric contact lenses by using as an abradant sodium chloride, sodium bicarbonate or a mixture of same. U.S. Pat. No. 4,731,125 discloses a method for removing adherent material from composite surfaces made of a reinforced matrix material using a granular media composed of particles which have a Mohs hardness of lower than 3.5. Preferably the abradant is polymeric particles having the desired Mohs hardness.

SUMMARY OF THE INVENTION

The present invention is directed to removing coatings such as paints, adhesives, etc. as well as scale and rust from structural steel surfaces. It is an object of the invention to utilize a blasting media which is not harmful to the environment and which can provide a uniform and sufficient anchoring pattern on the steel surface without providing an excessive anchor pattern such as to damage the surface or the structure.

The above objects are achieved by providing a blasting media which comprises trona, i.e., natural sodium sesquicarbonate ($Na_2CO_3.NaH\ CO_3.2H_2O$) and a minor amount of aluminum oxide. The blasting media is propelled to the steel surface by air, water or a mixture of air and water to remove the coating layers and provide a uniform anchoring pattern.

DETAILED DESCRIPTION OF THE INVENTION

The blasting media of this invention which is particularly useful in removing coatings either applied or formed on steel surfaces comprises trona and a minor amount relative to the trona of aluminum oxide. The trona is particularly useful as an abradant to remove coatings such as paints, adhesives, sealants, scale, rust and the like but, used alone, has been found to be too soft to provide a sufficient anchor pattern on the steel surface so as to provide acceptable adherence of a coating layer applied subsequent to mechanical blasting. On the other hand, while alumina oxide and other hard abradants such as silicon carbide have been suggested for use as a blasting media to remove coatings from steel, the use of these very hard abradants alone are believed to actually damage the surface and the structure itself which is being mechanically blasted. Accordingly, it has been found that a blasting medium comprising 80–95% by weight trona and 5–20% by weight aluminum oxide sufficiently removes the desired coating by mechanical blast and at the same time provides a uniform and adequate surface anchor pattern without damaging the surface or steel structure.

In its broadest aspect, the blasting media of the present invention comprises a relatively soft material which is capable of removing coatings by mechanical blast and which is water soluble and the inclusion therein of a relatively hard substance in minor amounts which is capable of providing a sufficient although not too extensive anchor pattern on steel surfaces. Thus, the major portion of the blasting media will comprise trona or equivalent water soluble substances which have a hardness of less than 3.5 on the Mohs scale. Non-limiting examples of useful water soluble soft abrasives include alkali and alkaline earth carbonate type materials including the preferred trona (natural sodium sesquicarbonate), sodium sesquicarbonate, sodium bicarbonate, sodium carbonate, potassium carbonate, magnesium carbonate, potassium bicarbonate, etc. It is important to note that by water soluble is not meant completely water soluble as some natural minerals including the preferred trona may contain minor amounts of insoluble materials. For example, trona may contain up to 10 wt. % insolubles. Besides being water soluble, it is also important that the soft blasting media be nontoxic and capable of being washed away from the blasting site without adversely effecting the environment. It is most preferred that the soft abrasive of the blasting media of this invention be devoid of siliceous materials which cause health problems including some metal silicates.

The minor component of the blasting media of this invention is a hard abrasive which can provide a sufficient anchor pattern on the steel surface and, since used in only minor amounts does not adversely effect the mechanical integrity of the steel structure being mechanically blasted for the removal of coating layers. In its broadest aspect, the blast media of the present invention encompasses the use of a minor amount of a hard abrasive having a hardness of at least 7.0 on the Mohs scale and includes the preferred aluminum oxide as well as silicon carbide, tungsten carbide, etc. Again, it is most preferred to avoid friable siliceous materials such as sand which is composed of silicon oxides and which may be harmful to health.

The particle size of the abrasive will range from about 50 to 2,000 microns, preferably from about 200 to about 1,000 microns for both the trona and aluminum oxide abradants.

The blasting media is applied to the steel surface by use of any known blasting equipment in which a fluid is used as the carrier for the blast medium. Preferably, air under pressure is utilized as the carrier medium for the blast media. A secondary source of water can be used as a curtain to hold down dust during blasting. It is also possible to use a small amount of water with the air as a carrier fluid which would act as both a carrier fluid and as a dust control mechanism. However, since the trona or other equivalent soft abrasive which is used is water soluble, the use of an excessive amount of water as the carrier to the steel substrate may substantially weaken the effectiveness of the trona abrasive. The trona and aluminum oxide may be premixed or such materials may be withdrawn from separate containers by known methods in which the aluminum oxide abrasive is carefully metered into the trona stream to provide the appropriate amount of the aluminum oxide relative to the trona. Typically, the mixture of trona, aluminum oxide, air and optionally water are passed through a nozzle which directs the blast medium to the steel surface being treated. Air pressures of approximately 50 to 110 psi are typically used with values of from 60 to 85 psi being preferred.

The invention will now be illustrated by the following examples which are not to be construed as limiting the scope of the appended claims to strictly those embodiments shown.

EXAMPLES

The ability of five different blast media to remove paint, mill scale and rust from a series of steel panels was tested by blasting the steel panels with the blast media in an air carrier which had a pressure of 85 psi. The compositions for each blast media are set out in Table 1. Sample Nos. 2 and 3 represent blast media falling within the scope of the present invention while Samples 1, 4 and 5 are comparative examples.

TABLE 1

| Sample No. | Ingredients | Percent |
|---|---|---|
| 1 | Armex Maintenance grade[1] | 90 |
| | Ferrosil 14[2] | 10 |
| 2 | Alkaten[3] | 90 |
| | Brown Aluminum Oxide 70[4] | 10 |
| 3 | Alkaten | 95 |
| | Brown Aluminum Oxide 70 | 5 |
| 4 | Alkaten | 95 |
| | Starblast XL[5] | 5 |
| 5 | Armex Maintenance grade | 100 |

[1]Sodium bicarbonate, average particle size of 150 microns, Church & Dwight, Princeton, N.J.

[2]Very fine feriosilicate, 98% less than 14 microns, Garnet Mineral

[3]Ground trona (natural sodium sesquicarbonate), average particle size about 250 microns, Church & Dwight

[4]Average particle size of about 350 microns

[5]Staurolite Residue, average particle size of about 150 microns, DuPont

EXAMPLE 1

Five different steel panels containing either mill scale, light rust, heavy rust or a coating of lead paint were blasted with the five sample compositions set forth in Table 1 using air under 85 psi pressure as the carrier. The painted panels comprised lead paint on steel in which the steel surface was solvent cleaned but did not contain an original profile nor was the mill scale removed. The results are shown in Table 2.

All of the abrasive samples which were tested flowed reasonably well with the exception of Sample 1. It is believed that the mixing of the Ferrosil with the sodium bicarbonate caused a breakdown in the particle size of the sodium bicarbonate and that therefore the flowability of the sample was adversely affected by the smaller granules of the bicarbonate.

Samples 2, 3 and 4 flowed well and had improved efficiency as far as coatings removal. Sample 2 performed best overall.

TABLE 2

| Sample No. | Mill Scale Removal Qual[1] | Mill Scale Removal Gauge[2] | Lite Rust[3] Removal | Heavy Rust[4] Removal | Paint Thickness Removal (mil) | Strip time (sec.) Per Sq. Ft. |
|---|---|---|---|---|---|---|
| 1 | 2 | 100 | 10 | 4 | 3.4 | :33 |
| | | | | | 3.6 | :31 |
| | | | | | 2.9 | :33 |
| | | | | | 2.9 | :25 |
| 2 | 7 | 600 | 7 | 7 | 3.4 | :17 |
| | (SP6)[5] | (1.1 mil)[7] | | | 3.6 | :18 |
| | | | | | 2.9 | :14 |
| | | | | | 2.9 | :16 |
| 3 | 5 | 375 | 8 | 7 | 2.9 | :12 |
| | (SP7)[6] | | | | 2.9 | :10 |
| | | | | | 3.6 | :15 |
| | | | | | 3.4 | :15 |
| 4 | 3 | 375 | 8 | 8 | 2.9 | :17 |
| | (SP7) | | | | 2.9 | :18 |
| | | | | | 3.6 | :19 |
| | | | | | 3.4 | :24 |
| 5 | No rating | | 9* | 4 | 3.6 | :26 |
| | | | | | 3.6 | :29 |

[1]Mill Scale removal rated 1-10 (pure Starblast = 10). (Qualitative)
[2]Profile rating 0-1000 using comparative gauge, with uncoated sandblasted panel rated 700.
[3]Lite Rust removal rated 1-10 (pure Starblast = 10). (Qualitative)
[4]Heavy rust removal rated 1-10 (pure Starblast = 10). (Qualitative)
[5]SSPC Standard for surface preparation. SP6 equivalent to Commercial Blast Cleaning Standard which is blast cleaning until at least two-thirds of the surface area is free of all visible residues.
[6]SP7 Brush-off Blast Cleaning Standard which is blast cleaning of all except tightly adhering residues of mill scale, rust and coatings
[7]Profile produced measured by Testex tape Sand = 3.1 mil, Starblast = 1.6 mil
*High value obtained for completeness, but removal was slower than other samples.

EXAMPLE 2

In this example four steel sheets which were painted with a lead paint were mechanically blasted as in Example 1. The steel panels were prepared via sand blasting prior to the application of the lead paint. Results are shown in Table 3.

TABLE 3

| Sample No. | Paint Thickness Removal (mil) | Strip Time (sec.) Per Sq. Ft. |
|---|---|---|
| 1 | 2.3 | :36 |
| | 2.7 | :34 |
| | 2.8 | :41 |
| | 2.3 | :30 |
| 2 | 2.3 | :23 |
| | 2.7 | :29 |
| | 2.8 | :27 |
| | 2.3 | :26 |
| 3 | 2.3 | :29 |
| | 2.8 | :29 |
| | 2.7 | :28 |
| | 2.3 | :26 |
| 4 | 2.3 | :45 |
| | 2.8 | :31 |
| | 2.7 | :37 |
| | 2.3 | :36 |
| 5 | 2.9 | :32 |
| | 2.9 | :29 |

EXAMPLE 3

In this example, the steel panels were coated with an epoxy paint. The panels were solvent cleaned previous to application of the coating as in Example 1. The results are shown in Table 4.

TABLE 4

| Sample No. | Paint Thickness Removal (mil) | Strip Time (sec.) Per Sq. Ft. |
|---|---|---|
| 1 | 8.1 | :56 |
| | 7.3 | :58 |
| | 8.6 | 1:10 |
| | 7.5 | :57 |

TABLE 4-continued

| Sample No. | Paint Thickness Removal (mil) | Strip Time (sec.) Per Sq. Ft. |
|---|---|---|
| 2 | 8.6 | 1:03 |
| | 7.2 | :46 |
| | 9.0 | 1.03 |
| | 7.2 | :33 |
| 3 | 7.7 | 1:04 |
| | 9.3 | :54 |
| | 7.2 | :43 |
| | 8.4 | :49 |
| 4 | 7.5 | 1:18 |
| | 8.6 | 1:14 |
| | 7.2 | :51 |
| | 8.8 | 1:29 |
| 5 | 7.7 | :42 |
| | 7.6 | :51 |

What is claimed is:

1. A blast media for removing coatings from steel comprising a major amount of a relatively soft granular abrasive which is water soluble and has a hardness of less than 3.5 on the Mohs scale and a minor amount of a relatively hard granular abrasive having a hardness greater than 7 on the Mohs scale, said granular abrasives having a particle size of from about 50 to 2,000 microns and being devoid of silicious material.

2. The blast media of claim 1 wherein said relatively soft abrasive is nontoxic.

3. The blast media of claim 1 wherein said relatively hard abrasive is aluminum oxide.

4. The blast media of claim 1 wherein said relatively soft abrasive is sodium bicarbonate.

5. The blast media of claim 4 wherein said relatively hard abrasive is aluminum oxide.

6. A blast media for removing coating from steel surfaces comprising a mixture of a relatively soft granular abrasive which is water soluble and has a hardness of less than 3.5 on the Mohs scale and a minor amount of a relatively hard granular abrasive having a hardness of greater than 7 on the Mohs scale, said granular abrasives having a particle size of from about 50 to 2,000 microns and being devoid of silicious material, and a fluid carrier which directs said granular abrasives to the steel surface.

7. The blast media of claim 6 wherein said relatively soft abrasive is nontoxic.

8. The blast media of claim 6 wherein said fluid carrier is air.

9. The blast media of claim 6 wherein said relatively hard abrasive is aluminum oxide.

10. The blast media of claim 6 wherein said relatively soft abrasive is sodium bicarbonate.

11. The blast media of claim 10 wherein said relatively hard abrasive is aluminum oxide.

12. A blast media for removing coatings from steel comprising a major amount of a relatively soft, water soluble granular abrasive comprising trona and a minor amount of a relatively hard granular abrasive having a hardness greater than 7 on the Mohs scale said granular abrasives having a particle size of from about 50 to 2,000 microns.

13. The blast media of claim 12 wherein said relatively hard abrasive is aluminum oxide.

14. The blast media of claim 13 comprising 80–95% by weight trona and 5–20% by weight aluminum oxide.

* * * * *